US011303025B2

(12) United States Patent
Zhao et al.

(10) Patent No.: US 11,303,025 B2
(45) Date of Patent: Apr. 12, 2022

(54) 5G DUAL-POLARIZED ANTENNA MODULE AND TERMINAL DEVICE

(71) Applicant: SHENZHEN SUNWAY COMMUNICATION CO., LTD., Guangdong (CN)

(72) Inventors: Yue Zhao, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 128 days.

(21) Appl. No.: 16/769,428

(22) PCT Filed: Apr. 7, 2020

(86) PCT No.: PCT/CN2020/083464
§ 371 (c)(1),
(2) Date: Jun. 3, 2020

(87) PCT Pub. No.: WO2021/139014
PCT Pub. Date: Jul. 15, 2021

(65) Prior Publication Data

US 2022/0006192 A1 Jan. 6, 2022

(30) Foreign Application Priority Data

Jan. 10, 2020 (CN) ..... 202010024407.3

(51) Int. Cl.
*H01Q 5/378* (2015.01)
*H01Q 1/24* (2006.01)
(Continued)

(52) U.S. Cl.
CPC ..... *H01Q 5/378* (2015.01); *H01Q 1/242* (2013.01); *H01Q 1/38* (2013.01); *H01Q 1/48* (2013.01);
(Continued)

(58) Field of Classification Search
CPC ..... H01Q 19/13; H01Q 21/28; H01Q 1/243
See application file for complete search history.

(56) References Cited

U.S. PATENT DOCUMENTS

2019/0027838 A1* 1/2019 Paulotto ..... H01Q 21/28
2021/0242568 A1* 8/2021 Zhang ..... H01Q 9/30

FOREIGN PATENT DOCUMENTS

CN 207517869 U 6/2018
CN 108288757 A 7/2018
(Continued)

OTHER PUBLICATIONS

Chen, S. et al., "LTCC Based Dual-Polarized Magneto-Electric Dipole Antenna for 5G Millimeter Wave Application," 13th European Conference on Antennas and Propagation (EuCAP 2019), 4 pages.
(Continued)

*Primary Examiner* — Ricardo I Magallanes
(74) *Attorney, Agent, or Firm* — Oliff PLC

(57) ABSTRACT

A 5G dual-polarized antenna module and a terminal device are disclosed. The 5G dual-polarized antenna module comprises a substrate, a first metal ground and at least one antenna unit group are disposed in the substrate, the first metal ground partitions the substrate into a first region and a second region, the antenna unit group includes a first antenna unit and a second antenna unit which are located in the first region, and the first antenna unit comprises a dipole element and a parasitic element matched with the dipole element; the second antenna unit comprises a T-shaped probe, which is partially located between the dipole element and the parasitic element; and a first ground layer conductive with the first metal ground is disposed on the bottom surface
(Continued)

of the substrate. The 5G dual-polarized antenna module thus being particularly suitable for light and thin terminal devices.

18 Claims, 10 Drawing Sheets

(51) Int. Cl.

| | |
|---|---|
| ***H01Q 1/38*** | (2006.01) |
| ***H01Q 5/20*** | (2015.01) |
| ***H01Q 21/24*** | (2006.01) |
| ***H01Q 9/16*** | (2006.01) |
| ***H01Q 1/48*** | (2006.01) |
| ***H01Q 21/28*** | (2006.01) |
| ***H01Q 19/13*** | (2006.01) |
| ***H01Q 1/50*** | (2006.01) |

(52) U.S. Cl.

CPC ..... *H01Q 1/50* (2013.01); *H01Q 5/20* (2015.01); *H01Q 9/16* (2013.01); *H01Q 21/24* (2013.01); *H01Q 1/243* (2013.01); *H01Q 19/13* (2013.01); *H01Q 21/28* (2013.01)

(56) References Cited

FOREIGN PATENT DOCUMENTS

| | | | |
|---|---|---|---|
| CN | 207781866 | U | 8/2018 |
| CN | 109193133 | A | 1/2019 |
| CN | 109193134 | A | 1/2019 |
| CN | 109244646 | A | 1/2019 |
| CN | 208460981 | U | 2/2019 |
| CN | 208655889 | U | 3/2019 |
| CN | 110176668 | A | 8/2019 |
| CN | 110401020 | A | 11/2019 |
| CN | 110649382 | A | 1/2020 |
| WO | 2019/165193 | A1 | 8/2019 |
| WO | WO-2021013010 | A1 * | 1/2021 |

OTHER PUBLICATIONS

Sep. 3, 2020 International Search Report issued in International Patent Application No. PCT/CN2020/083464.

* cited by examiner

5G DUAL-POLARIZED ANTENNA MODULE AND TERMINAL DEVICE

TECHNICAL FIELD

The invention relates to the technical field of antennas, in particular to a 5G dual-polarized antenna module and a terminal device.

DESCRIPTION OF RELATED ART

The fifth-generation (5G) wireless communication technology will be soon commercially used. In accordance with the communication frequency, 5G can be divided into a sub-6 GHz frequency band and a millimeter wave (MMW) frequency band, wherein the MMW frequency band is rich in spectrum resources, can greatly increase the communication rate and has the advantage of low delay. Compared with previous low-frequency bands which have been widely applied, the path loss during MMW transmission is large, and the MMW transmission distance is short, and hence, it is necessary to constitute an array by multiple antenna units to increase the gain and to fulfill a beam-forming capacity.

Accompanied with the technological innovation, new challenges have brought to the design of MMW antennas. Up to now, there have already been some designs of MMW antennas applied to handheld devices, but most existing MMW antennas have certain problems. For example, Chinese Invention Patents (Publication No. CN109193133A and Publication No. CN109193134A) put forward a series of antennas designed on metal frames, but the integration of such antennas with radio frequency front ends still remains unresolved. Antennas provided by Chinese Utility Model Patent "5G MMW Mobile Phone Antenna Based on Rectangular Patch Array" (Publication No. CN208655889U), Chinese Utility Model Patent "Four-unit MMW Antenna System for Mobile Communication Terminal" (Publication No. CN208460981U), and Chinese Utility Model Patent "Compact Wideband MMW Antenna" (Publication No. CN207781866U) are all designed based on broadside radiation. These antennas have to be vertically disposed on side faces of mobile phones to fulfill lateral radiation, which restrains the ultra-thin design of the mobile phones. Chinese Utility Model Patent "End-radiation MMW Antenna with Controllable Radiation Direction" (Publication No. CN207517869U) and Chinese Utility Model Patent "Wireless Mobile Terminal and Antenna" (Publication No. CN108288757A) provide antenna units that can fulfill end radiation, but such antennas are single-polarized. Dual-polarized antennas are needed in actual application. Recently, Qualcomm has launched a dual-polarized MMW antenna module based on rectangular patch antennas; however, because the principal radiation direction of the antenna module is perpendicular to the surface of the patch antennas, the antenna module has to be vertically disposed on the side edge of mobile phones to satisfy the requirement for lateral radiation of the mobile phones, which directly affects the thickness of the mobile phones.

BRIEF SUMMARY OF THE INVENTION

The technical issue to be settled by the invention is to provide a 5G dual-polarized antenna module which can fulfill lateral radiation and has a small thickness, and a terminal device.

The technical solution adopted by the invention to settle the aforesaid technical issue is as follows: a 5G dual-polarized antenna module comprises a substrate, wherein a first feed port and a second feed port are formed in the surface of the substrate, a first metal ground and at least one antenna unit group are disposed in the substrate, the first metal ground partitions the substrates into a first region and a second region, the first feed port and the second feed port are located in the second region, the antenna unit group includes a first antenna unit and a second antenna unit which are located in the first region, and the first antenna unit comprises a dipole element connected to the first feed port and a parasitic element matched with the dipole element; the second antenna unit comprises a T-shaped probe, which is connected to the second feed port and is partially located between the dipole element and the parasitic element; and a first ground layer conducive with the first metal ground is disposed on the bottom surface of the substrate.

A terminal device comprises the 5G dual-polarized antenna module.

The invention has the following beneficial effects: the 5G dual-polarized antenna module of the invention has the advantage of dual polarization, can fulfill lateral radiation, and has a small thickness, thus being particularly suitable for light and thin terminal devices (such as mobile phones); the 5G dual-polarized antenna module can be manufactured through an LTCC or multi-layer circuit board process, thus being more conducive to subsequent chip integration than metal frame-based designs; and the 5G dual-polarized antenna module can cover the 5G MMW band (from 24.75 GHz to 27.5 GHz) in China and the 5G MMW band (from 27.5 GHz to 28.35 GHz) in America, thus having a broad application prospect.

REFERENCE SIGNS

Figure 1:
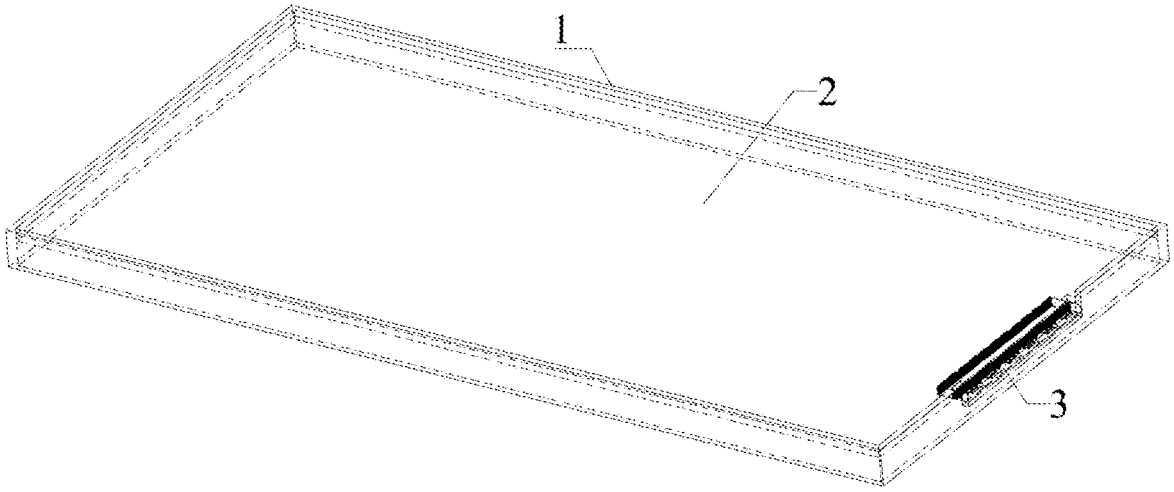
FIG. 1 is a structural view of a terminal device in Embodiment 1 of the invention.

1, frame; 2, mainboard; 3, 5G dual-polarized antenna module; 4, substrate; 5, first feed port; 6, second feed port; 7, first metal ground; 8, antenna unit group; 9, first region; 10, second region; 11, first antenna unit; 12, second antenna unit; 13, dipole element; 14, parasitic element; 15, first ground layer; 16, first branch; 17, second branch; 18, second metal ground; 19, first vertical metal ground; 20, first horizontal metal ground; 21, third branch; 22, fourth branch; 23, fifth branch; 24, sixth branch; 25, isolation wall; 26, second horizontal meal ground; 27, second vertical metal ground; 28, notch; 29, second ground layer; 30, shield ground; 31, radio frequency chip; 32, control chip; 33, seventh branch; 34, eighth branch.

DETAILED DESCRIPTION OF THE INVENTION

The technical contents, purposes and effects of the invention are expounded below in conjunction with the embodiments and accompanying drawings.

Referring to FIG. 1 to FIG. 19, a 5G dual-polarized antenna module comprises a substrate 4, wherein a first feed port 5 and a second feed port 6 are formed in the surface of the substrate 4, a first metal ground 7 and at least one antenna unit group 8 are disposed in the substrate 4, the first metal ground 7 partitions the substrate 4 into a first region 9 and a second region 10, and the first feed port 5 and the second feed port 6 are located in the second region 10; the antenna unit group 8 includes a first antenna unit 11 and a second antenna unit 12 which are located in the first region 9, and the first antenna unit 11 comprises a dipole element 13 connected to the first feed port 5 and a parasitic element 14 matched with the dipole element 13; the second antenna unit 12 comprises a T-shaped probe, which is connected to the second feed port 6 and is partially located between the dipole element 13 and the parasitic element 14; and a first ground layer 15 conductive with the first metal ground 7 is disposed on the bottom surface of the substrate 4.

The operating principle of the invention is as follows: the first antenna unit 11 can fulfill horizontal polarization, and the second antenna unit 12 can fulfill vertical polarization.

From the above description, the invention has the following beneficial effects: the 5G dual-polarized antenna module of the invention has the advantage of dual polarization, can fulfill lateral radiation, and has a small thickness, thus being particularly suitable for light and thin terminal devices (such as mobile phones); the 5G dual-polarized antenna module can be manufactured through an LTCC or multi-layer circuit board process, thus being more conducive to subsequent chip integration than metal frame-based designs; and the 5G dual-polarized antenna module can cover the 5G MMW band (from 24.75 GHz to 27.5 GHz) in China as well as the 5G MMW band (from 27.5 GHz to 28.35 GHz) in America, thus having a broad application prospect.

Furthermore, the first antenna unit 11 further comprises a first branch 16 and a second branch 17 connected to the first branch 16, wherein the first branch 16 is connected to the first feed port 5, and an end, away from the first branch 16, of the second branch 17 penetrates through the first metal ground 7 to be connected to the dipole element 13.

From the above description, the first metal ground 7 has a first via hole allowing the second branch 17 to penetrate through.

Furthermore, the 5G dual-polarized antenna module further comprises a second metal ground 18 disposed in the substrate 4, wherein the second metal ground 18 comprises a first vertical metal ground 19 and a first horizontal metal ground 20 connected to the first vertical metal ground 19, the first vertical metal ground 19 is located between the first feed port 5 and the second feed port 6, and the first horizontal metal ground 20 is connected to the first metal ground 7 and is located below the second branch 17.

From the above description, the second metal ground 18, the first branch 16 and the second branch 17 constitute a micro-strip structure; and the second metal ground 18 can further isolate the first antenna unit 11 from the second antenna unit 12 to guarantee the performance of the antenna module.

Furthermore, the second antenna unit 12 further comprises a third branch 21 and a fourth branch 22 connected to the third branch 21, wherein the third branch 21 is connected to the second feed port 6, and an end, away from the third branch 21, of the fourth branch 22 penetrates through the first metal ground 7 to be connected to the probe; and the probe comprises a fifth branch 23 and a sixth branch 24 connected to the fifth branch 23, the fifth branch 23 is connected to the fourth branch 22 and is located between the dipole element 13 and the parasitic element 14, and the sixth branch 24 is located on the top surface of the substrate 4.

From the above description, the first metal ground 7 has a second via hole allowing the fourth branch 22 to penetrate through.

Furthermore, an isolation wall 25 is disposed in the substrate 4, is located in the first region 9 and comprises a second horizontal metal ground 26 and two second vertical metal grounds 27, wherein the second horizontal metal ground 26 is connected to the two second vertical metal grounds 27, the second vertical metal grounds 27 are connected to the first ground layer 15, and the antenna unit group 8 is partially located in the isolation wall 25.

From the above description, when multiple antenna unit groups 8 are configured, the isolation wall 25 can fulfill good isolation between two adjacent antenna unit groups 8 to guarantee the electrical properties of the antenna module.

Furthermore, the second vertical metal grounds 27 are connected to the first metal ground 7.

From the above description, two adjacent antenna unit groups 8 can be further isolated.

Furthermore, multiple antenna unit groups 8 are disposed in the substrate 4 and are arrayed in one row, and notches 28 are formed in the first ground layer 15 and are respectively located between every two adjacent antenna unit groups 8.

From the above description, the notches 28 can further improve the isolation between two adjacent antenna unit groups 8.

Furthermore, a second ground layer 29 connected to the first metal ground 7 is disposed on the top surface of the substrate 4 and corresponds to the second region 10.

From the above description, the second region 10 can form a metal cavity through the configuration of the second ground layer 29.

Furthermore, the substrate 4 is made of low-temperature co-fired ceramic or a multi-layer circuit board.

From the above description, the antenna module is easy to machine and conducive to subsequent chip integration and can be easily produced by manufacturers.

A terminal device comprises the 5G dual-polarized antenna module 3.

From the above description, the terminal device can fulfill lateral radiation, and thus can be made lighter and thinner.

Embodiment 1

Figure 2:
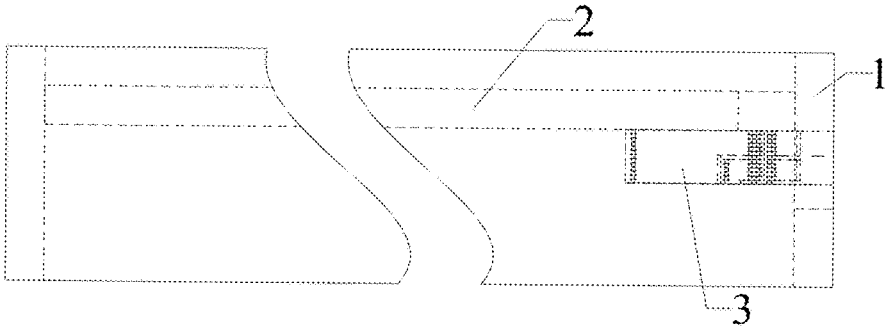
FIG. 2 is a side perspective view of the terminal device in Embodiment 1 of the invention.

Referring to FIG. 1 to FIG. 18, Embodiment 1 of the invention provides a terminal device which, as shown in FIG. 1 and FIG. 2, comprises a frame 1 and a mainboard 2 disposed in the frame 1, wherein a 5G dual-polarized antenna module 3 is disposed on the mainboard 2, and a hole allowing the 5G dual-polarized antenna module 3 to be inlaid therein is formed in the frame 1. Particularly, the 5G dual-polarized antenna module 3 is disposed below the mainboard 2.

Referring to FIG. 3 to FIG. 6, the 5G dual-polarized antenna module 3 comprises a substrate 4, wherein a first feed port 5 and a second feed port 6 are formed in the surface of the substrate 4, a first metal ground 7 and at least one antenna unit group 8 are disposed in the substrate 4, the first metal ground 7 partitions the substrate 4 into a first region 9 and a second region 10, the first feed port 5 and the second feed port 6 are located in the second region 10, the antenna unit group 8 comprises a first antenna unit 11 and a second antenna unit 12 which are located in the first region 9, and the first antenna unit 11 comprises a dipole element 13 connected to the first feed port 5 and a parasitic element 14 matched with the dipole element 13; the second antenna unit 12 comprises a T-shaped probe, which is connected to the second feed port 6 and is partially located between the dipole element 13 and the parasitic element 14; and a first ground layer 15 conductive with the first metal ground 7 is disposed on the bottom surface of the substrate 4. The substrate 4 is made of low-temperature co-fired ceramic or a multi-layer circuit board to facilitate subsequent chip integration. In this embodiment, substrate 4 includes thirteen layers of low-temperature co-fired ceramic, and the thickness of each layer of low-temperature co-fired ceramic is 100 um. The 5G dual-polarized antenna module 3 in this embodiment has a small overall thickness (generally less then 2 mm), and thus has no influence on the thickness of the terminal device.

Figure 3:
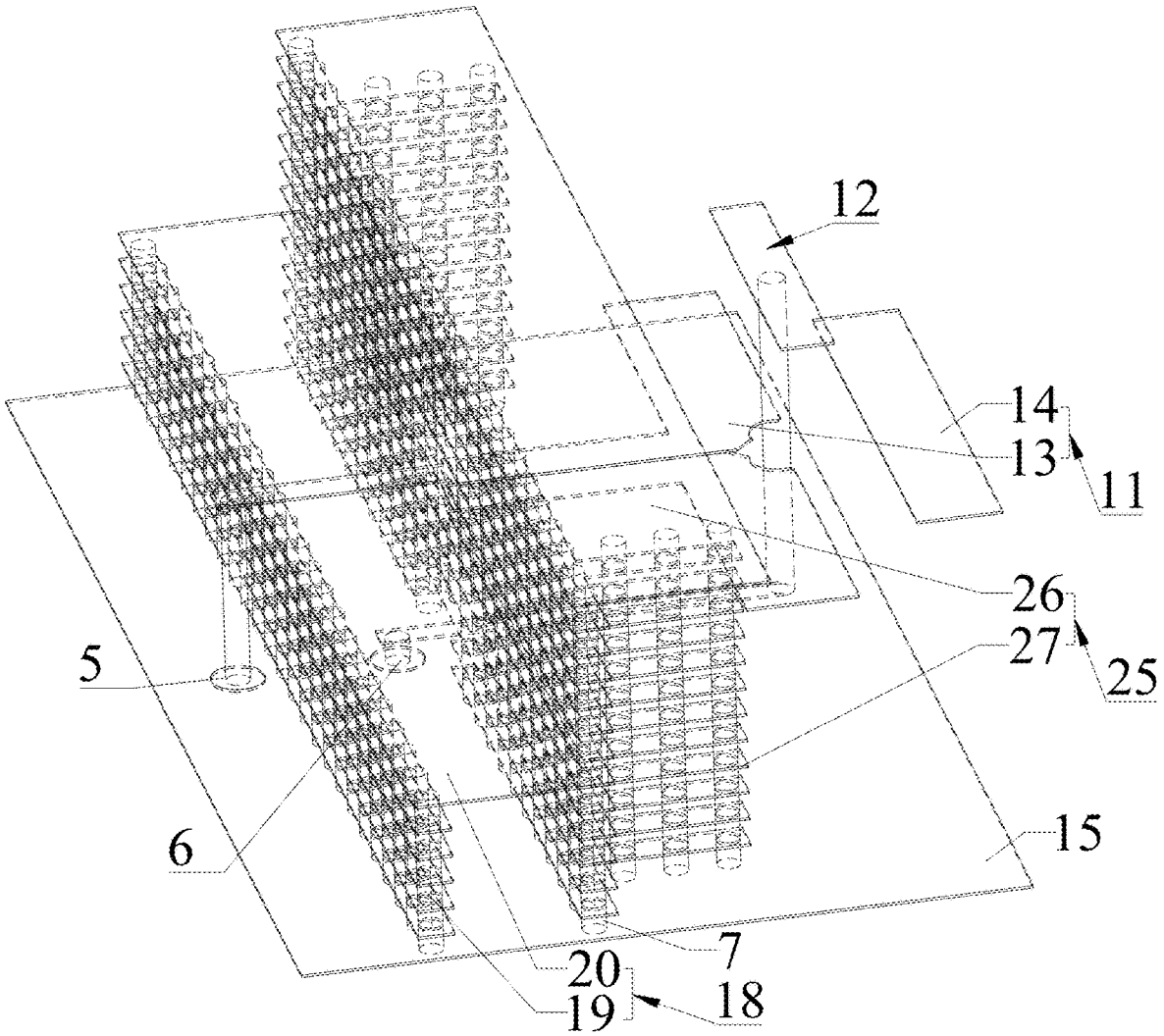
FIG. 3 is a structural view of an antenna unit group of a 5G dual-polarized antenna module in Embodiment 1 of the invention (a substrate is hidden)
Figure 4:
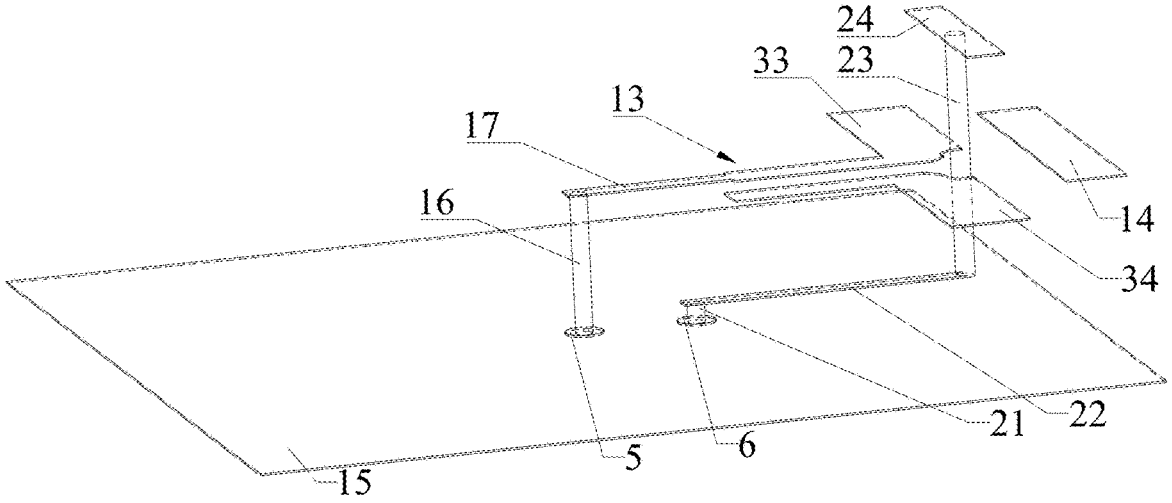
FIG. 4 is a structural view of the antenna unit group of the 5G dual-polarized antenna module in Embodiment 1 of the invention (the substrate, a first metal ground, a second metal ground and an isolation wall are hidden)
Figure 5:
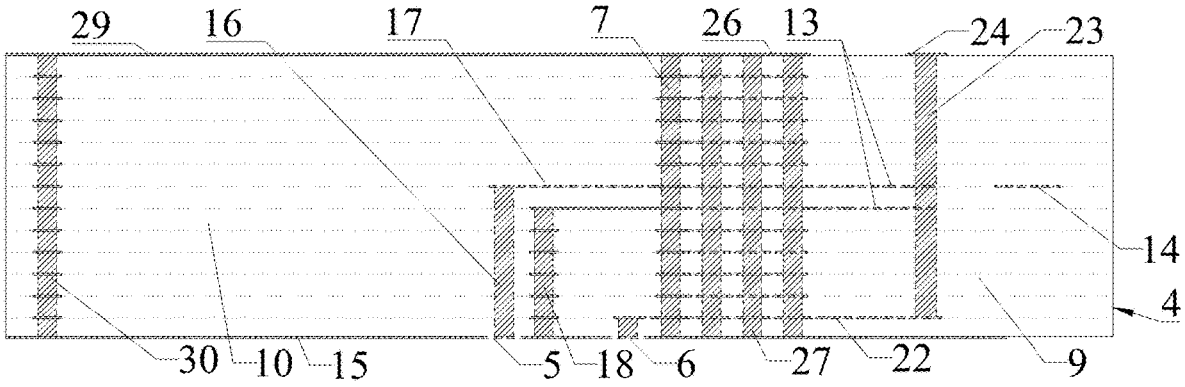
FIG. 5 is a side perspective view of the antenna unit group of the 5G dual-polarized antenna module in Embodiment 1 of the invention.

Particularly, referring to FIG. 3 to FIG. 5, the first antenna unit 11 further comprises a first branch 16 and a second branch 17 connected to the first branch 16, wherein the first branch 16 is connected to the first feed port 5, and an end, away from the first branch 16, of the second branch 17 penetrates through the first metal ground 7 to be connected to the dipole element 13. Preferably, the 5G dual-polarized antenna module further comprises a second metal ground 18 disposed in the substrate 4, wherein the second metal ground 18 comprises a first vertical metal ground 19 and a first horizontal metal ground 20 connected to the first vertical metal ground 19, the first vertical metal ground 19 is located between the first feed port 5 and the second feed port 6, and the first horizontal metal ground 20 is connected to the first metal ground 7 and is located below the second branch 17, so that a micro-strip structure is formed by the second metal ground 18, the first branch 16 and the second branch 17. Optionally, the first vertical metal ground 19 is parallel to the first metal ground 7.

Referring to FIG. 4 and FIG. 5, the second antenna unit 12 further comprises a third branch 21 and a fourth branch 22 connected to the third branch 21, wherein the third branch 21 is connected to the second feed port 6, and an end, away from the third branch 21, of the fourth branch 22 penetrates through the first metal ground 7 to be connected to the probe; and the probe comprises a fifth branch 23 and a sixth branch 24 connected to the fifth branch 23, wherein the fifth branch 23 is connected to the fourth branch 22 and is located between the dipole element 13 and the parasitic element 14, and the sixth branch 24 is located on the top surface of the substrate 4. The dipole element 13 comprises an L-shaped seventh branch 33 and an L-shaped eighth branch 34, wherein the seventh branch 33 is connected to the second branch 17, and the eighth branch 34 is located below the seventh branch 33 and is connected to the first metal ground 7. Optionally, receding notches for making room for the fifth branch 23 are formed in the seventh branch 33 and the eighth branch 34, respectively. Specifically, the parasitic element 14 is in a sheet shape and is coplanar with the seventh branch 33.

Figure 7:
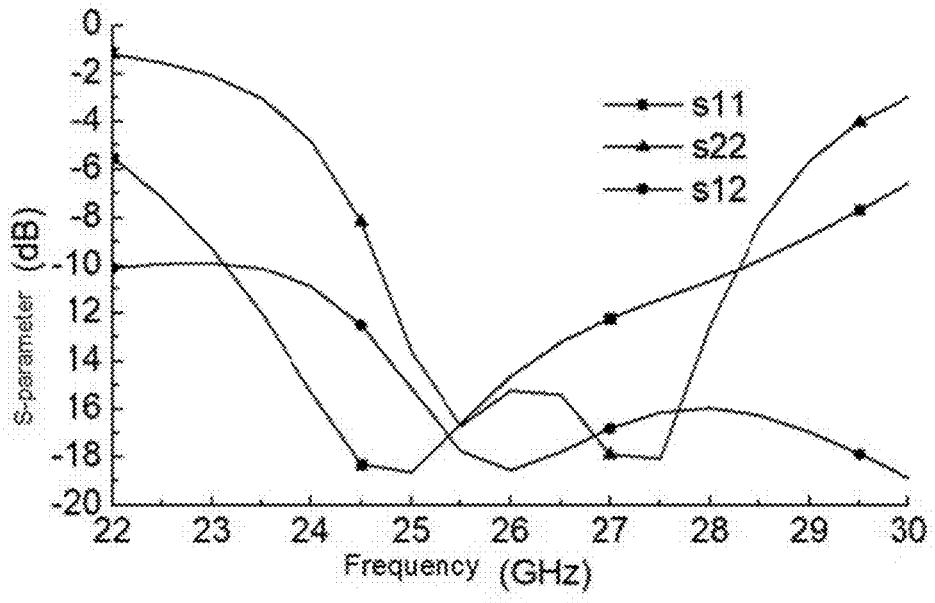
FIG. 7 is an S-parameter diagram of the antenna unit group of the 5G dual-polarized antenna module in Embodiment 1 of the invention
Figure 8:
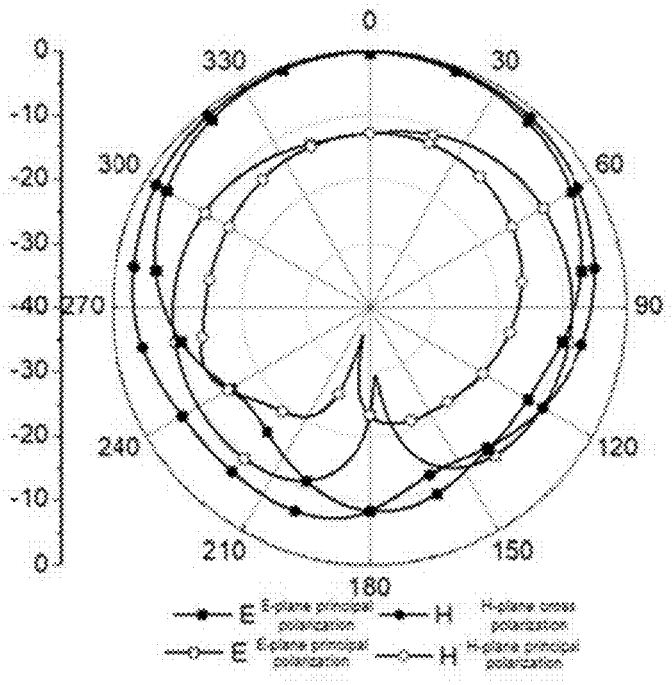
FIG. 8 is a directional diagram of the antenna unit group of the 5G dual-polarized antenna module in Embodiment 1 of the invention (excitation via a first feed port)
Figure 9:
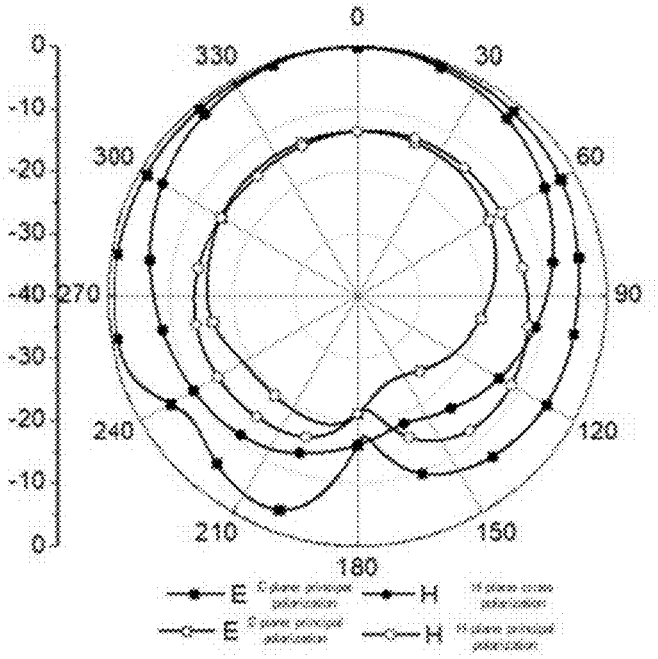
FIG. 9 is a directional diagram of the antenna unit group of the 5G dual-polarized antenna module in Embodiment 1 of the invention (excitation via a second feed port)

FIG. 7 is an S-parameter diagram of the antenna unit group of the 5G dual-polarized antenna module. As can be seen from FIG. 7, within the frequency band of 24.75-28.35 GHz, the return loss (s11 and s22) of the antenna unit group is less than −10 dB, and the isolation of the two ports (|s21|) is superior to 14 dB. FIG. 8 and FIG. 9 are directional diagrams of the antenna unit group of the 5G dual-polarized antenna module. As can be seen from FIG. 8 and FIG. 9, the antenna unit group can fulfill directed radiation and has good cross polarization.

Referring to FIG. 3, FIG. 5, FIG. 6, FIG. 10 and FIG. 11, due to the large path loss during MMW transmission and the short MMW transmission distance, it is necessary to form an array by multiple antenna unit groups 8 to increase the gain and to fulfill a beam-forming capacity, that is, multiple antenna unit groups 8 are configured and are arrayed in one row. In this embodiment, the number of the antenna unit groups 8 is six. To guarantee the isolation between every two adjacent antenna unit groups 8, an isolation wall 25 is disposed in the substrate 4, is located in the first region 9 and comprises a second horizontal metal ground 26 and two second vertical metal grounds 27, wherein the second horizontal metal ground 26 is connected to the two second vertical metal grounds 27, the second vertical metal grounds 27 are connected to the first ground layer 15, and the antenna unit group 8 is partially located in the isolation wall 25. The second vertical metal grounds 27 and the second horizontal metal ground 26 are connected to the first metal ground 7. More specifically, the second vertical metal grounds 27 are perpendicular to the first metal ground 7.

Figure 10:
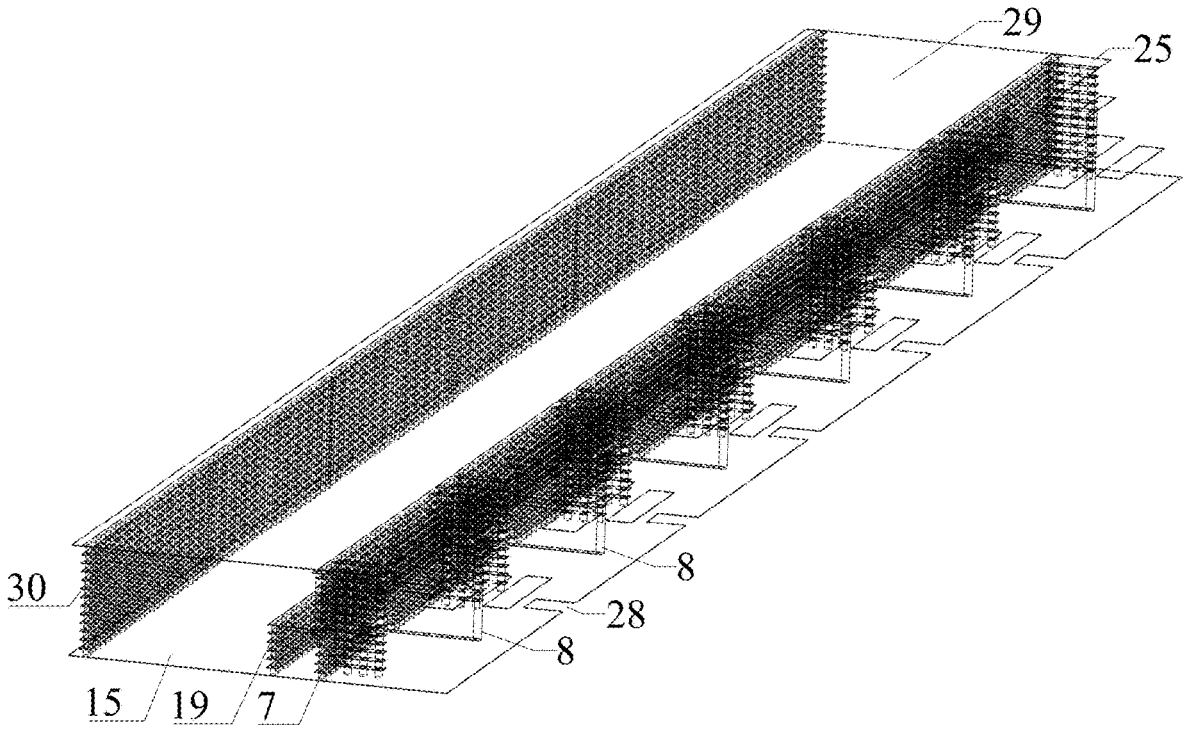
FIG. 10 is a structural view of the 5G dual-polarized antenna module in Embodiment 1 of the invention (the substrate is hidden)
Figure 11:
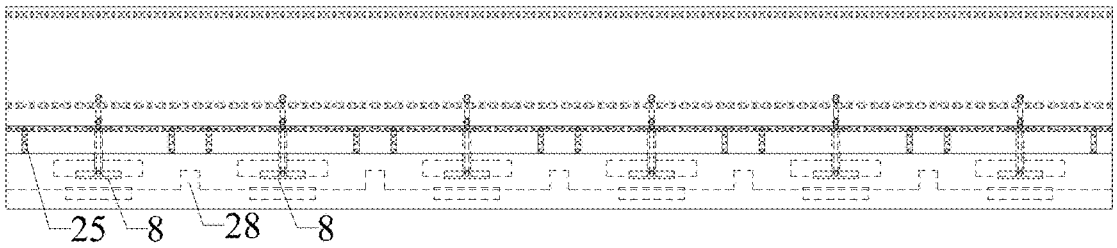
FIG. 11 is a top view of the 5G dual-polarized antenna module in Embodiment 1 of the invention.

As shown in FIG. 10 and FIG. 11, to further improve the isolation between two adjacent antenna unit groups 8, notches 28 are optionally formed in the first ground layer 15 and are respectively located between every two adjacent antenna unit groups 8.

Figure 6:
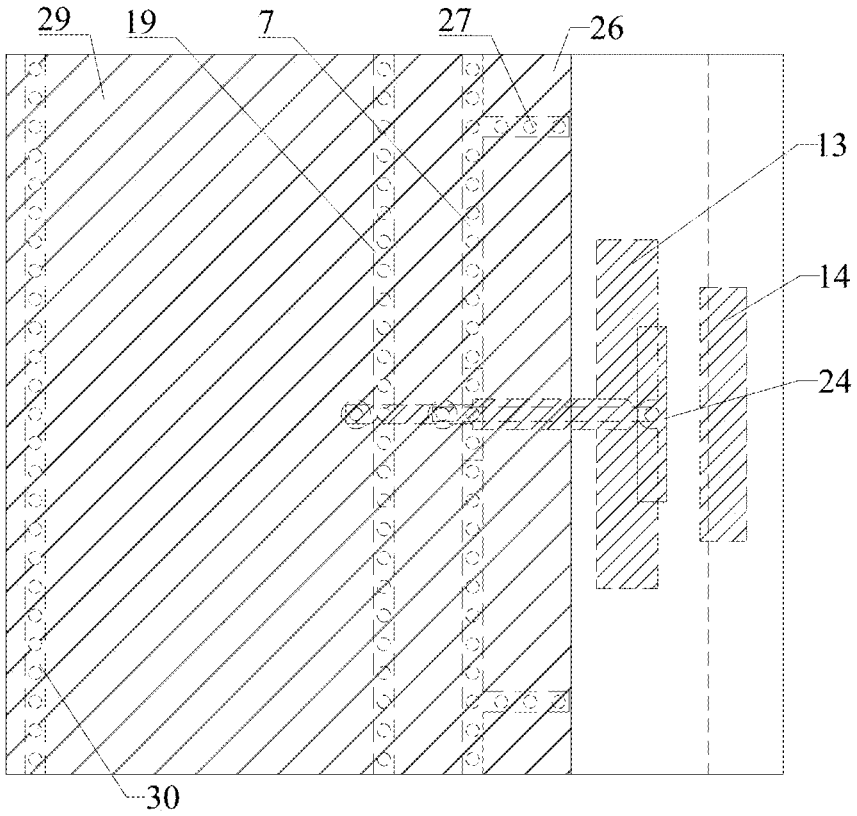
FIG. 6 is a top view of the antenna unit group of the 5G dual-polarized antenna module in Embodiment 1 of the invention

Optionally, as shown in FIG. 5, FIG. 6 and FIG. 10, a second ground layer 29 connected to the first metal ground 7 is disposed on the top surface of the substrate 4 and corresponds to the second region 10. Furthermore, a shield ground 30 is disposed at an end, away from the first region 9, of the second region 10 and is connected to the first ground layer 15 and the second ground layer 29. In this way, the second region 10 forms a sealed metal cavity, manufacturers can dispose feed lines in the metal cavity, and even filters, switches and other elements can be disposed in the metal cavity as required.

Understandably, the substrate 1 in this embodiment is made of low-temperature co-fired ceramic (in other embodiments, the substrate 4 may be a multi-layer circuit board), and the first metal ground 7, the first vertical metal ground 19, the second vertical metal grounds 27, and the shield ground 30 are mesh structures.

Figure 12:
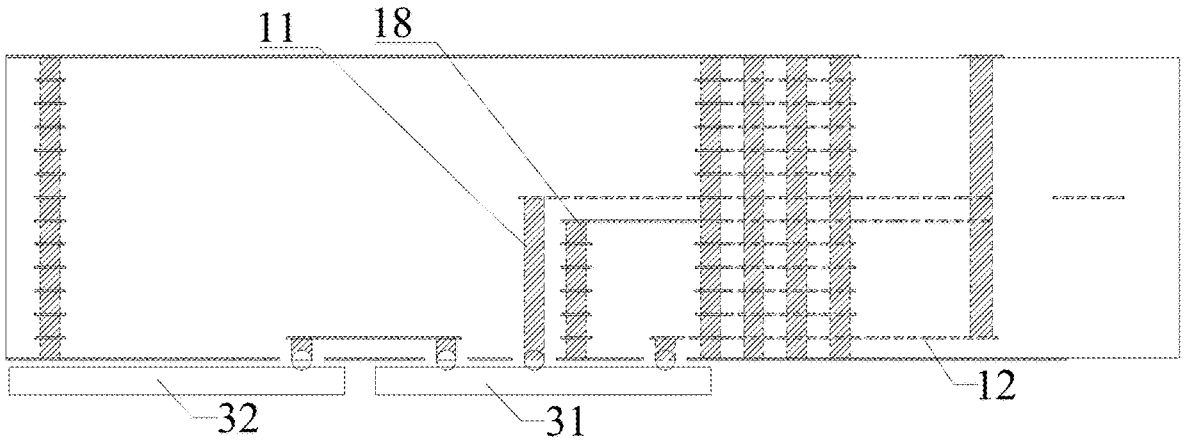
FIG. 12 is a side perspective view of the 5G dual-polarized antenna module in Embodiment 1 of the invention.

As shown in FIG. 12, this embodiment further provides a solution for integrating a six-unit array with a radio frequency front end. Particularly, the substrate 4 is provided with a radio frequency chip 31 and a control chip 32, wherein the radio frequency chip 31 is electrically connected to the first feed port 5, the second feed port 6 and the control chip 32. The radio frequency chip 31 comprises a phase shifter, an amplifier and other elements, wherein the phase shifter provides a phase difference for the antenna unit groups 8 to fulfill a beam scanning capacity, and the amplifier compensates for the loss of the phase shifter. Optionally, the first feed port 5 and the second feed port 6 are located on the bottom surface of the substrate 4 and are isolated from the first ground layer 15. Correspondingly, the control chip 32 and the radio frequency chip 31 are both disposed at the bottom of the substrate 4 and are isolated from the antenna unit group 8 by the first ground layer 15. In this way, the control chip 32 and the radio frequency chip 31 will not disturb the antenna unit group 8, and the performance of the antenna module is further guaranteed.

Figure 13:
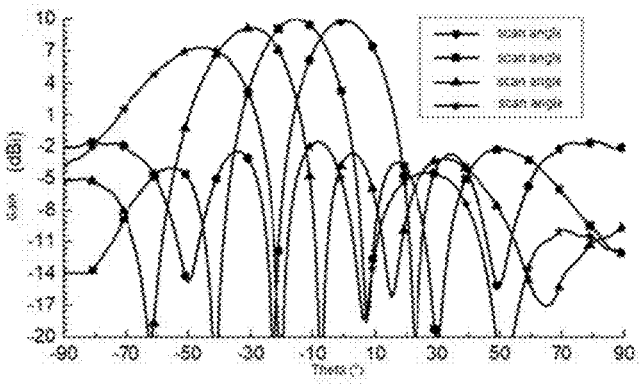
FIG. 13 is a scanning direction diagram of the 5G dual-polarized antenna module at 26.5 GHz under horizontal polarization of 0°-45° in Embodiment 1 of the invention.
Figure 14:
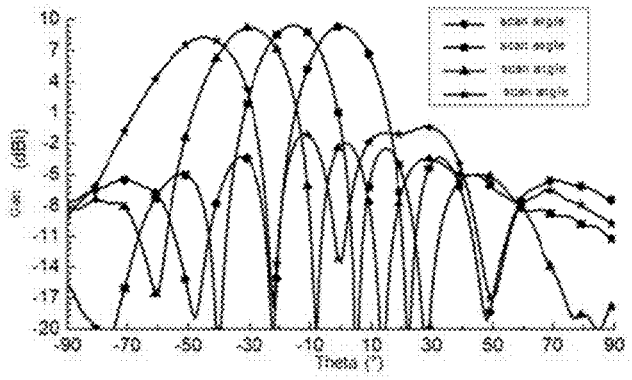
FIG. 14 is a scanning direction diagram of the 5G dual-polarized antenna module at 26.5 GHz under vertical polarization of 0°-45° in Embodiment 1 of the invention.
Figure 15:
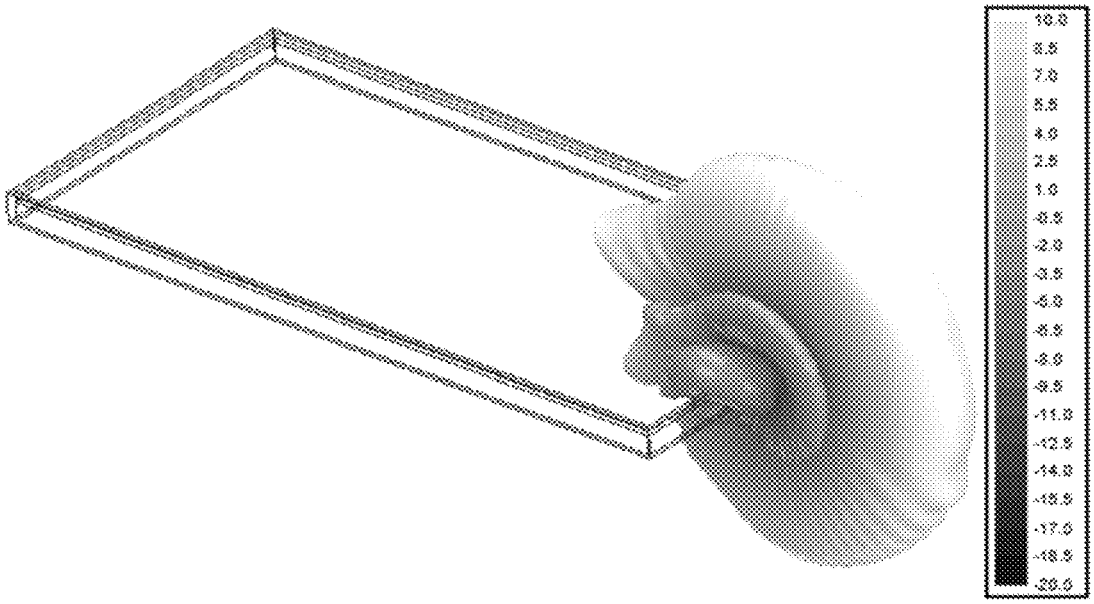
FIG. 15 is a 3D radiation direction diagram of the 5G dual-polarized antenna module in the terminal device at 26.5 GHz in Embodiment 1 of the invention (under a scan angle of 0° and vertical polarization)
Figure 16:
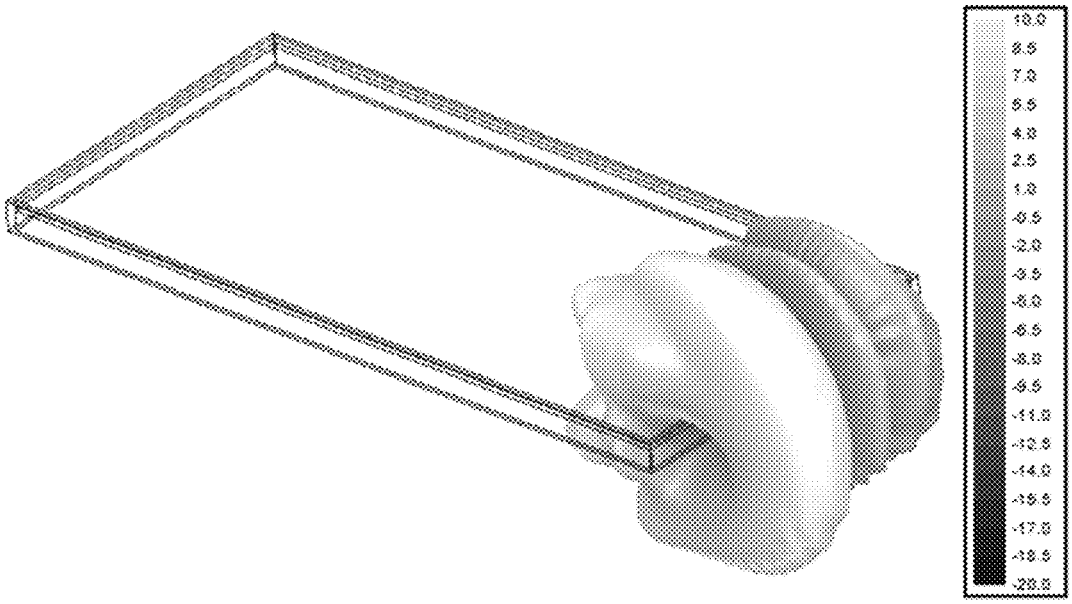
FIG. 16 is a 3D radiation direction diagram of the 5G dual-polarized antenna module in the terminal device at 26.5 GHz in Embodiment 1 of the invention (under a scan angle of 45° and vertical polarization)
Figure 17:
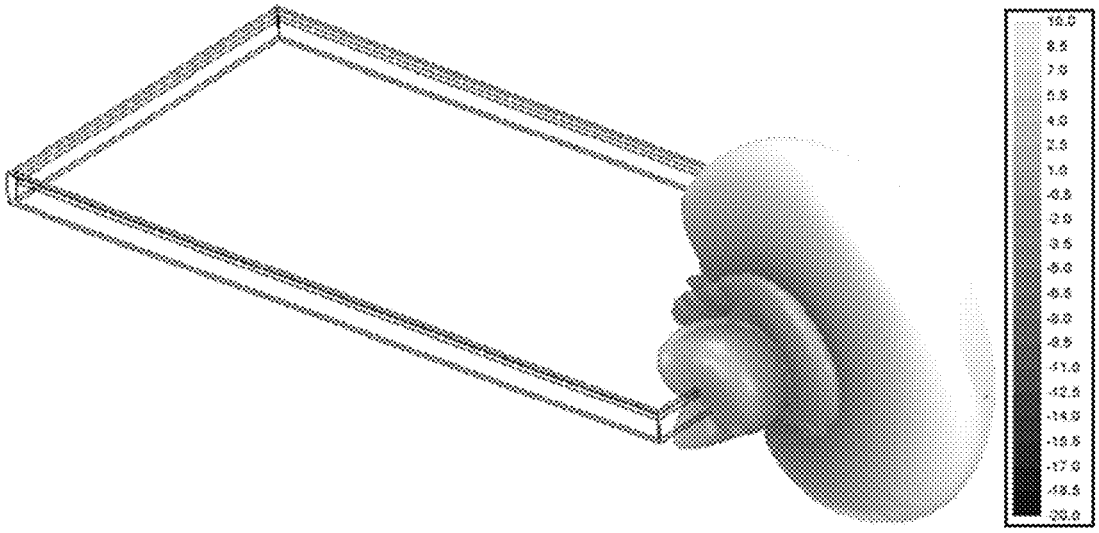
FIG. 17 is a 3D radiation direction diagram of the 5G dual-polarized antenna module in the terminal device at 26.5 GHz in Embodiment 1 of the invention (under a scan angle of 0° and horizontal polarization)
Figure 18:
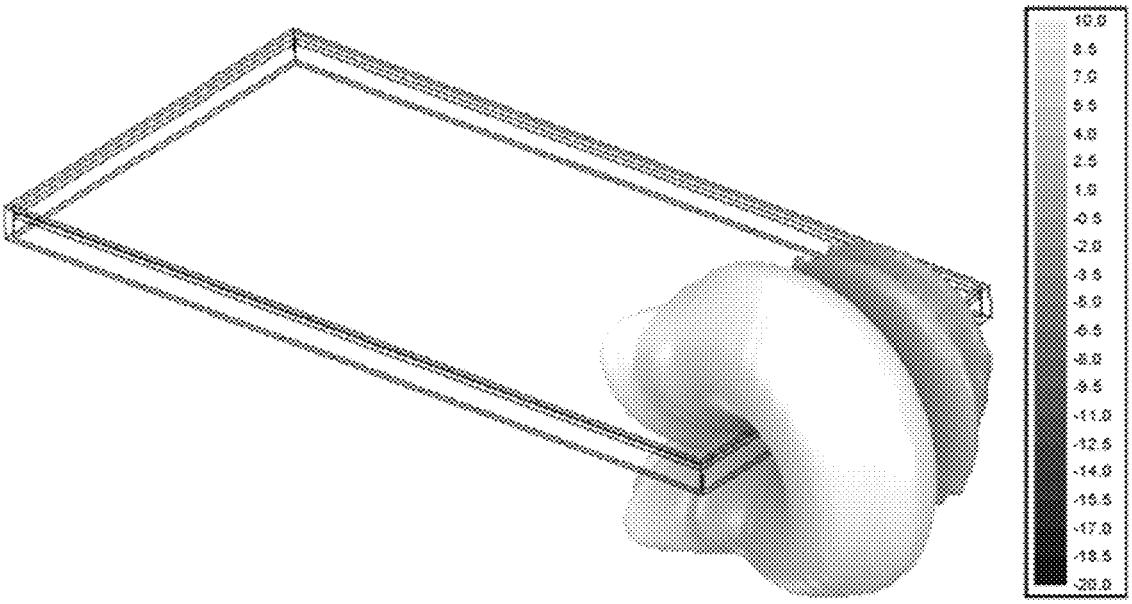
FIG. 18 is a 3D radiation direction diagram of the 5G dual-polarized antenna module in the terminal device at 26.5 GHz in Embodiment 1 of the invention (under a scan angle of 45° and horizontal polarization)

FIG. 13 is scanning direction diagram of the 5G dual-polarized antenna module at 26.5 GHz under horizontal polarization of 0°-45° in Embodiment 1 of the invention, and FIG. 14 is a scanning direction diagram of the 5G dual-polarized antenna module at 26.5 GHz under vertical polarization of 0°-45° in Embodiment 1 of the invention. As can be seen from FIG. 13 and FIG. 14, under horizontal polarization of 0°-45° and vertical polarization of 0°-45°, the gain in the direction diagrams is stable, and the scanning performance is good.

FIG. 15 to FIG. 18 are 3D direction diagrams of the 5G dual-polarized antenna module at 26.5 GHz in Embodiment 1 of the invention. As can be clearly seen from FIG. 15 to FIG. 18, the 5G dual-polarized antenna module can fulfill lateral radiation to the terminal device and has a beam scanning capacity.

Embodiment 2

Figure 19:
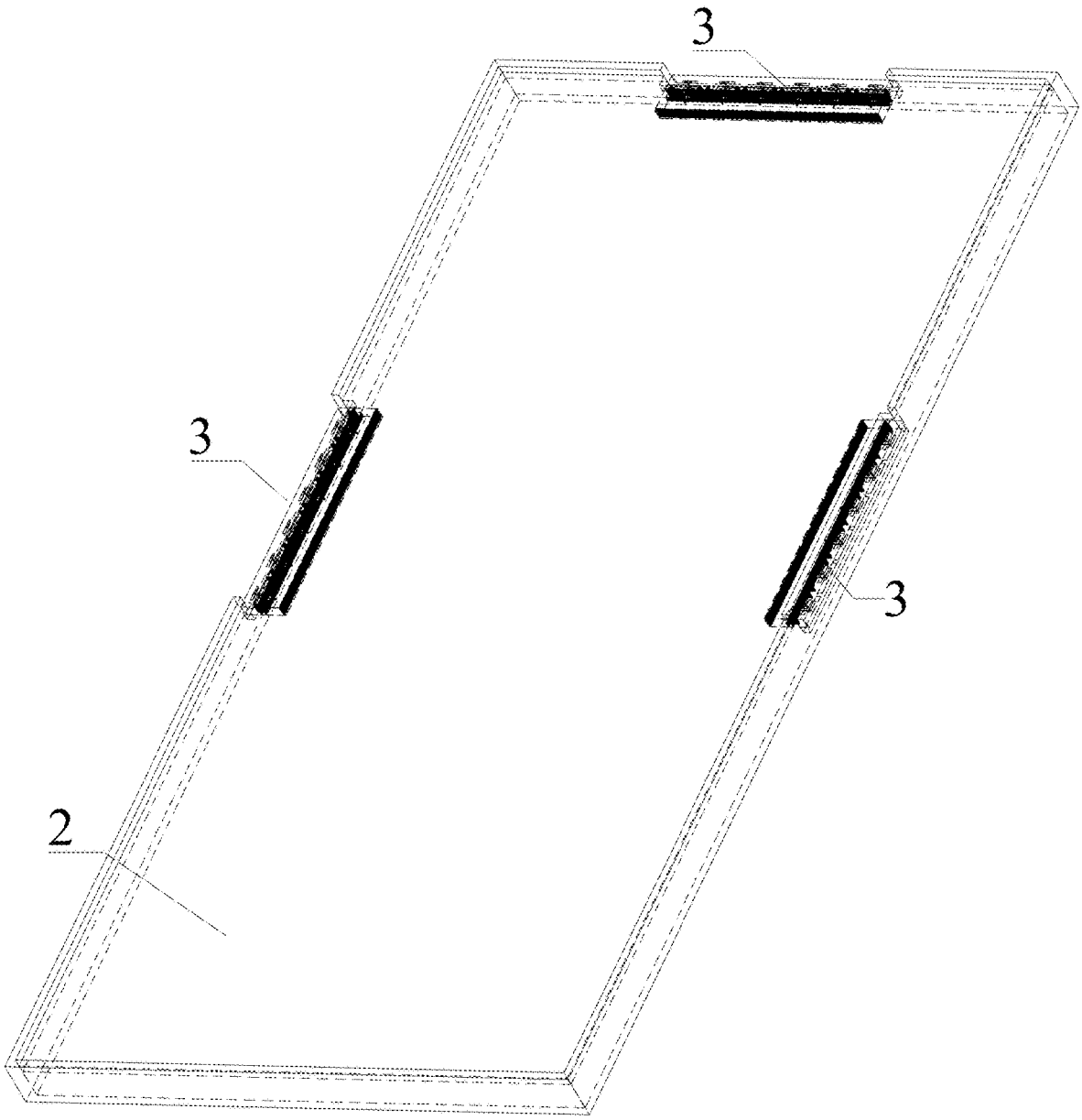
FIG. 19 is a structural view of a terminal device in Embodiment 2 of the invention.

Referring to FIG. 19, Embodiment 2 of the invention provides another technical solution on the basis of Embodiment 1, and differs from Embodiment 1 in that the 5G dual-polarized antenna modules 3 are disposed on three sides of the mainboard 2 of the terminal device to fulfill multidirectional coverage.

To sum up, the 5G dual-polarized antenna module and the terminal device provided by the invention have the advantage of dual polarization, can fulfill lateral radiation, and have a small thickness, thus conforming to the development trend of light and thin terminal devices; the 5G dual-polarized antenna module can be manufactured through an LTCC or multi-layer circuit board process, thus being more conducive to subsequent chip integration than metal frame-based designs; and the 5G dual-polarized antenna module can cover the 5G MMW band (from 24.75 GHz to 27.5 GHz) in China and the 5G MMW band (from 27.5 GHz to 28.35 GHz) in America, thus having a broad application prospect.

The above description is only used to explain the embodiments of the invention, and is not intended to limit the patent scope of the invention. All equivalent transformations made on the basis of the contents of the specification and accompanying drawings, or direct or indirect applications to relating technical fields should also fall within the patent protection scope of the invention.

The invention claimed is:

1. A 5G dual-polarized antenna module, comprising a substrate, wherein a first feed port and a second feed port are formed in a surface of the substrate, a first metal ground and at least one antenna unit group are disposed in the substrate, the first metal ground partitions the substrate into a first region and a second region, the first feed port and the second feed port are located in the second region, the antenna unit group includes a first antenna unit and a second antenna unit which are located in the first region, and the first antenna unit comprises a dipole element connected to the first feed port and a parasitic element matched with the dipole element; the second antenna unit comprises a T-shaped probe, which is connected to the second feed port and is partially located between the dipole element and the parasitic element; and a first ground layer conductive with the first metal ground is disposed on a bottom surface of the substrate.

2. The 5G dual-polarized antenna module according to claim 1, wherein the first antenna unit further comprises a first branch and a second branch connected to the first branch, the first branch is connected to the first feed port, and an end, away from the first branch, of the second branch penetrates through the first metal ground to be connected to the dipole element.

3. The 5G dual-polarized antenna module according to claim 2, further comprising a second metal ground disposed in the substrate, wherein the second metal ground comprises a first vertical metal ground and a first horizontal metal ground connected to the first vertical metal ground, the first vertical metal ground is located between the first feed port and the second feed port, and the first horizontal metal ground is connected to the first metal ground and is located below the second branch.

4. The 5G dual-polarized antenna module according to claim 1, wherein the second antenna unit further comprises a third branch and a fourth branch connected to the third branch, the third branch is connected to the second feed port, and an end, away from the third branch, of the fourth branch penetrates through the first metal ground to be connected to the probe; and the probe comprises a fifth branch and a sixth branch connected to the fifth branch, the fifth branch is connected to the fourth branch and is located between the dipole element and the parasitic element, and the sixth branch is located on a top surface of the substrate.

5. The 5G dual-polarized antenna module according to claim 1, wherein an isolation wall is disposed in the substrate, is located in the first region and comprises a second horizontal metal ground and two second vertical metal grounds, the second horizontal metal ground is connected to the two second vertical metal grounds, the second vertical metal grounds are connected to the first ground layer, and the antenna unit group is partially located in the isolation wall.

6. The 5G dual-polarized antenna module according to claim 5, wherein the second vertical metal grounds are connected to the first metal ground.

7. The 5G dual-polarized antenna module according to claim 1, wherein multiple said antenna unit groups are disposed in the substrate and are arrayed in one row, and notches are formed in the first ground layer and are respectively located between every two adjacent said antenna unit groups.

8. The 5G dual-polarized antenna module according to claim 1, wherein a second ground layer connected to the first metal ground is disposed on a top surface of the substrate and corresponds to the second region.

9. The 5G dual-polarized antenna module according to claim 1, wherein the substrate is made of low-temperature co-fired ceramic or a multi-layer circuit board.

10. A terminal device, wherein the terminal device comprises a 5G dual-polarized antenna module, the 5G dual-polarized antenna module comprises a substrate, a first feed port and a second feed port are formed in a surface of the substrate, a first metal ground and at least one antenna unit group are disposed in the substrate, the first metal ground partitions the substrate into a first region and a second region, the first feed port and the second feed port are located in the second region, the antenna unit group includes a first antenna unit and a second antenna unit which are located in the first region, and the first antenna unit comprises a dipole element connected to the first feed port and a parasitic element matched with the dipole element; the second antenna unit comprises a T-shaped probe, which is connected to the second feed port and is partially located between the dipole element and the parasitic element; and a first ground layer conductive with the first metal ground is disposed on a bottom surface of the substrate.

11. The terminal device according to claim 10, wherein the first antenna unit further comprises a first branch and a second branch connected to the first branch, the first branch is connected to the first feed port, and an end, away from the first branch, of the second branch penetrates through the first metal ground to be connected to the dipole element.

12. The terminal device according to claim 11, further comprising a second metal ground disposed in the substrate, wherein the second metal ground comprises a first vertical metal ground and a first horizontal metal ground connected to the first vertical metal ground, the first vertical metal ground is located between the first feed port and the second feed port, and the first horizontal metal ground is connected to the first metal ground and is located below the second branch.

13. The terminal device according to claim 10, wherein the second antenna unit further comprises a third branch and a fourth branch connected to the third branch, the third branch is connected to the second feed port, and an end, away from the third branch, of the fourth branch penetrates through the first metal ground to be connected to the probe; and the probe comprises a fifth branch and a sixth branch connected to the fifth branch, the fifth branch is connected to the fourth branch and is located between the dipole element and the parasitic element, and the sixth branch is located on a top surface of the substrate.

14. The terminal device according to claim 10, wherein an isolation wall is disposed in the substrate, is located in the first region and comprises a second horizontal metal ground and two second vertical metal grounds, the second horizontal metal ground is connected to the two second vertical metal grounds, the second vertical metal grounds are connected to the first ground layer, and the antenna unit group is partially located in the isolation wall.

15. The terminal device according to claim 14, wherein the second vertical metal grounds are connected to the first metal ground.

16. The terminal device according to claim 10, wherein multiple said antenna unit groups are disposed in the substrate and are arrayed in one row, and notches are formed in the first ground layer and are respectively located between every two adjacent said antenna unit groups.

17. The terminal device according to claim 10, wherein a second ground layer connected to the first metal ground is disposed on a top surface of the substrate and corresponds to the second region.

18. The terminal device according to claim 10, wherein the substrate is made of low-temperature co-fired ceramic or a multi-layer circuit board.

* * * * *